US005990407A

United States Patent [19]

Gannon

[11] Patent Number: 5,990,407

[45] Date of Patent: Nov. 23, 1999

[54] AUTOMATIC IMPROVISATION SYSTEM AND METHOD

[75] Inventor: Peter Gannon, Victoria, Canada

[73] Assignee: PG Music, Inc., Victoria, Canada

[21] Appl. No.: 08/678,089

[22] Filed: Jul. 11, 1996

[51] Int. Cl.[6] ..... G10H 1/38

[52] U.S. Cl. ..... 84/613; 84/604; 84/609; 84/637

[58] Field of Search ..... 84/604–607, 609–613, 84/634–637

[56] References Cited

U.S. PATENT DOCUMENTS

| | | | |
|---|---|---|---|
| 4,926,737 | 5/1990 | Minamitaka | 84/611 |
| 5,278,348 | 1/1994 | Etaki et al. | 84/636 |
| 5,347,083 | 9/1994 | Suzuki et al. | 84/613 |
| 5,451,709 | 9/1995 | Minamitka | 84/609 |
| 5,627,335 | 5/1997 | Rigopulos et al. | 84/635 |
| 5,663,517 | 9/1997 | Oppenheim | 84/649 |

*Primary Examiner*—Bentsu Ro
*Assistant Examiner*—Marlon T. Fletcher
*Attorney, Agent, or Firm*—Graybeal Jackson Haley LLP

[57] ABSTRACT

A system and method for generating new musical improvisations, based on a database of existing improvisations. An automated method for converting the existing improvisations to a database and generating a new improvisation from the database. Musical improvisations are performed by musicians and stored in MIDI Data format. The Chord symbols used and key signature are input, and added to the improvisation. The system analyzes the performances, and information about sections and phrases of the solo are stored in a "Riffs" file. The musicians' original performances, the chord symbols and the Riffs files are combined into a Soloist Database File, consisting of one or more improvisations. An Options file is created by the user to control parameters about the solo to be generated. The system then generates a new improvisation based on any input chord progression and key, and the Options file, by choosing portions of the Soloist Database to construct the new improvisation.

52 Claims, 3 Drawing Sheets

AUTOMATIC IMPROVISATION SYSTEM AND METHOD

BACKGROUND

For use with computerized electronic devices, music may be described with data representing the pitch value of each note, the timing of each note, and the sound character of each note. The standard of such data representation is known as MIDI. Such data representations of music are used to record performances by musicians, typically performed at electronic keyboards. The sequences of notes with timing information may be stored in computer-readable media for subsequent electronic generation of music. When the music is generated, each note may be converted to sound by playing back a recorded snippet of the sound of an acoustic musical instrument. Similarly, sequences of many notes played on an acoustic instrument may be recorded for such assembly and playback.

Whether the sound data is stored as a MIDI sequence or as a recording from a musical instrument, the sequence may represent an entire performance or may be a short pattern that is repeated as accompaniment for simultaneous performance by a user, typically called a "style". A style is selected by a user and the system then generates the sequence of notes based on a particular rhythm and a particular chord. Styles typically contain one or two or four bars based on a single chord selected by the user and are endlessly repeated and transposed when the user selects a different chord. Such systems do not generate a melody or a "solo".

Computer systems are known which generate melodies or solos based on numeric rules for rhythm and a numerically generated melody, such as U.S. Pat. No. 4,616,547. However, melodies or solos generated by such methods do not sound like they are generated by humans and are seldom attractive to humans.

SUMMARY OF THE INVENTION

The present invention is a system for automatically generating new musical improvisations or solos based on a database of existing improvisations. The basis for selecting and assembling portions of pre-recorded solos is the chord progression, including the root and extension for each chord, of both the portion of the original performance and the improvisation to be generated.

First, a database containing numerous musical performances is created. For each performance, data is stored in a memory representing a sequence of notes and timing for each note. In the preferred form, each performance is stored as MIDI data, but the performances may also be stored as sound recordings, either digital with a timing track or analog with a timing track. To the database is added a specification of the sequence of chord roots which is associated with the sequence of notes. The timing of the chord changes is matched to the timing data for the notes. In addition to the chord roots, the extensions for each chord and the key signature for each performance are added.

Each of the recorded performances is then processed with a computer to identify portions of the performances which might be assembled in a new combination to create a new performance. When the new performance is created, portions of many different original performances can be combined. Each portion which might be suitable for subsequent combinations is identified as a "riff". For each riff, in addition to storing the sequence of chord roots, a sequence of parameters is calculated and stored, one parameter for each root. The parameter is based, at least in part, on the chord extension.

To generate a new improvisation, the user specifies a sequence of chords, including chord root and chord extension. The system then calculates the parameter for each extension and compares the sequence of chord roots and parameters to the pre-recorded portions of performances to find portions which match the sequence of chord roots and parameters. In the preferred embodiment, additional factors are also considered. Following the user-input sequence of chords, one riff after another is selected for the database and the selected riffs are assembled into a performance.

The embodiments of the invention include a method and a system for creating databases based on actual performances by musicians, the computer-readable database which is reproduced and distributed to end users, and a method and a system for using the distributed database to generate improvisations.

BRIEF DESCRIPTION OF THE DRAWINGS

A

DETAILED DESCRIPTION OF THE PREFERRED EMBODIMENT

Figure 1:
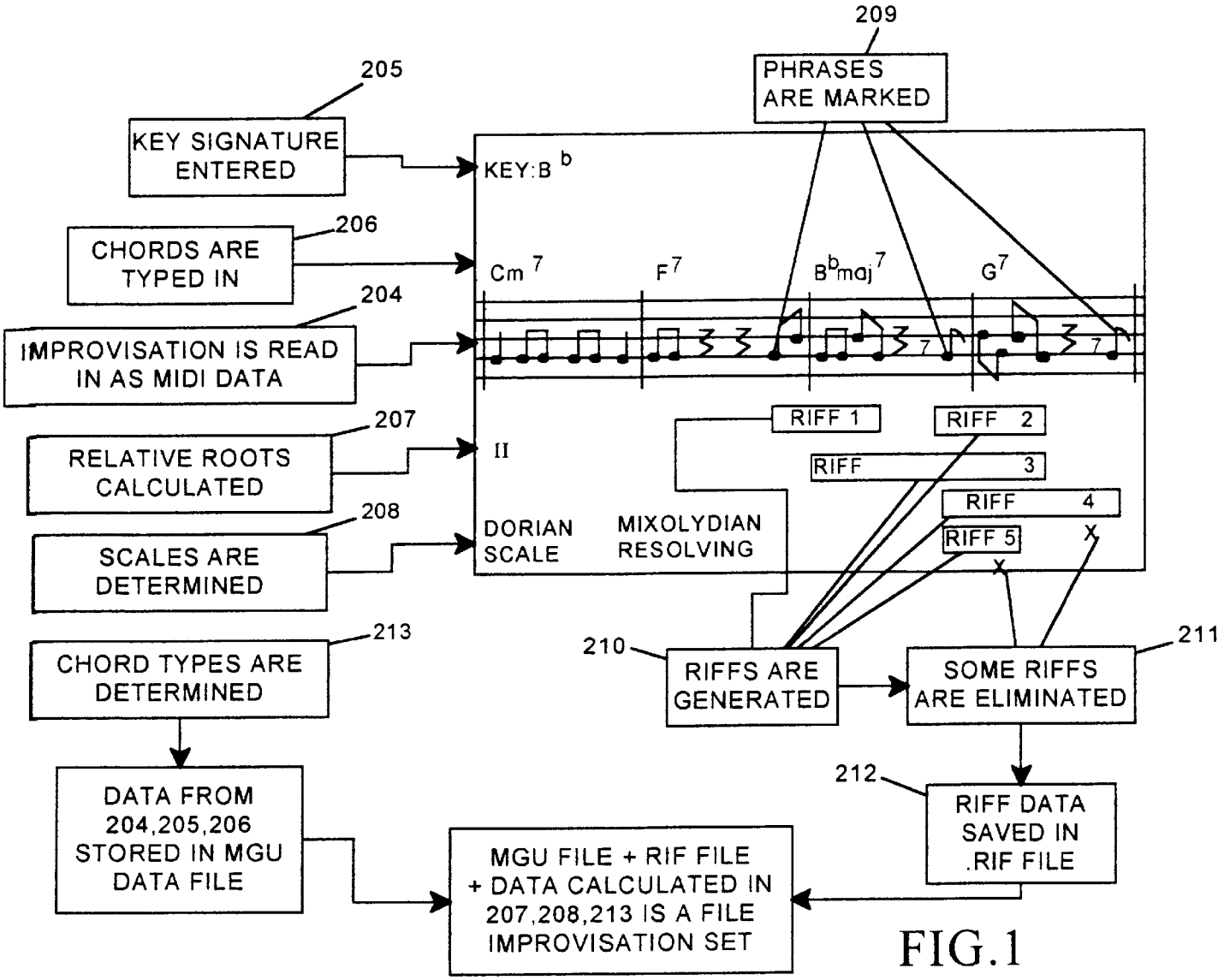
FIG. 1 is a diagram of the computer program system used to combine the MIDI Data with chord symbols, and generate files based on the MIDI Data, Chord symbols and Riff files.

Musical improvisations are performed by musicians and stored in MIDI Data format. The chord symbols used, and key signature are input, using a computer program system. From this point on, an automated process begins which will create new improvisations to any song, the new song being defined by input chord symbols and key signature. The MIDI Data performances are automatically analyzed by the system, and information about sections and phrases of the solo are stored in a "Riffs" file.

The musicians' performances and the Riffs files are combined into a Soloist Database File, consisting of one or more improvisations and Riffs files. This database consist of one or more "Improvisation File Sets". Each file set consists of:

1. The full improvisation, exactly as performed by the musician.

2. The chord progression used, and the key of the song. The chord progression is analyzed and a scale progression is determined which is also stored with the file.

3. A "Riffs File". The improvisation is analyzed by the system. "Phrases" are identified, and a "Riffs File" is generated, based on the complete and partial phrases found in the improvisation. Each phrase or partial phrase is referred to as a "Riff". Data about each Riff is stored in the Riffs file, including the duration of the riff, start and end time, highest note, scales used, key, and chords used.

Options are chosen by the user to control parameters about the solo to be generated. This includes information about the desired improvisation to generate, such as the instrument type (trumpet, guitar etc.), note range, style (swing jazz, bossa nova), phrasing style (long phrases, short phrases), and others.

The system then generates a new improvisation. This is based on:

1. A "song" input by the user. This includes a key, and chord progression. It doesn't include the melody.

2. The Soloist Database.

3. The Options selected by the User.

When generating a solo, the system uses internal rules, in combination with the rules selected in the User Options file, to search its Soloist Database to find portions ("Riffs" ) of the improvisation database that will match the scales and chords of the song. When a Riff is chosen, that portion of the original improvisation database will be copied to the new improvisation. This process is repeated until the entire improvisation is generated.

To automatically generate an improvisation, the system needs the following:

1. The Soloist Database.
2. The User Options file.
3. A "song" input by the user. This includes a key and a chord progression. It doesn't include the melody.

With these inputs, the system generates an improvisation.

The Soloist Database is prepared based on improvisations recorded by musicians. Musicians' improvisations are recorded as MIDI Data to a sequencer, and then to a Data file. The Soloist Database consists of "Improvised File Sets". Each Improvised File Sets consist of:

1. The original, unaltered improvisation as recorded by the musician in MIDI Data format.
2. Chord symbols and Key signature input to the computer program.
3. Calculated data (Scales, Chord Extensions, Relative Roots) stored in a "ScaleChordRootDataArray".
4. Riff file generated based on #1, #2 #3.

Items 1–3 are stored in a .MGU data file. Item #4 is stored in a .RIF data file.

Preparing an Improvised File Set from an Improvisation

FIG. 1 shows the components of a computer system that is used to create the Improvised File Sets which are the building blocks of the Soloist Database.

The MIDI file data is imported into a computer system, by reading the file into a structure 204 consisting of timing and note information. Each member of the data structure for the sequence consists of the following data:

(1) StartTimeOfEvent: 4 bytes, expressed as "ticks", with 1 tick=1/120 quarter note;

(2) MIDIData: status byte, note number, velocity;

(3) Duration of note: expressed in "ticks" (2 bytes);

(4) ScoreBits: These are 16 bits used for miscellaneous data. Bit 0 is used for phrase markings.

The key signature 205 of the song is entered from a list of 34 possible key signatures (see Appendix D). Chord symbols 206 are added. The computer screen is pre-divided into bars and beats. The operator of the program types in the chord symbols that the improvisation was based on, using standard chord symbols like "C" or "F#m7" or "Gm7/C". From an entered chord string, the system matches the entered chord with a list of acceptable chord names (roots, extensions, and alternate bass note). The system recognizes seventeen possible roots, over one hundred possible chord extensions, and twelve possible bass notes (see Appendices A, B, C for lists). If a match is found, the chord is accepted, and stored in RAM into an array of bars and beats as follows. The Chord Root is stored as one byte, the Extension is stored as one byte, the bass note (alternate root) is stored as one byte.

For example, the chord CMaj7/E (read as "C Major Seventh with E bass) is stored as follows: ChordRoot=1, ChordExtension=6, BassRoot=4. This array contains the chord information for each new chord symbol added by the user. A second array is calculated from the first array. It holds the same information, but stores the information of the current chord, extension, and bass root for each beat.

From the array containing the sequence of chords relative to the beats and measures, a "Relative Root" array is created that lists the root of each chord relative to the number of semitones away from the Key. For example, in the key of Eb, the following roots would be assigned the corresponding "Relative Root": Eb=0, E=1, F=2, F#=3, G=4, G#=5, A=6, Bb=7, B=8, C=9, Db=10, D=11.

A scale is assigned for each beat of the improvisation 208. Each chord extension is classified into one of ten chord types using a lookup table of the more than one hundred chords. The ten types of chords are: major, major7, minor, minor7, minor7b5, diminished, suspended, suspended7, lydian dominant, and altered dominant. Based on the chord type, the "Relative Root" of the chord, and the next chord, a scale is assigned from a list of fourteen possible scales. The possible scales are: Ionian Major, Lydian Major, Dorian Minor, Fridjian Minor, Aolian Minor, Harmonic Minor, Mixo-Lydian Dominant, Mixo-Lydian Resolving, Lydian Dominant7, Altered Dominant, Blues, Suspended, HalfDiminished, and Diminished.

Scales are assigned to each beat of the sequence, using an algorithm described in Appendix E. For each beat, we have now calculated the following from the chords and key of the song:

1. Scale Number.
2. Chord Extension Number.
3. Relative Root.

This data comprises the "ScaleChordRootData Array" for the improvisation.

The "ScaleChordRootData Array" is stored in memory, and can be regenerated from the input chords and key that are stored in the .MGU file. The key number of the improvisation, the input chords of the song, and the MIDI Data are saved in the .MGU file.

Generating the RIFF file for the Improvisation

The improvisation is analyzed by the software to identify "phrases" 209. If there is a space between notes of 1½ beats or more in the improvisation, and there have been at least 4 notes since the last phrase began, a new phrase marking is created. This is done by setting bit 0 of the "ScoreBits" field of the NoteEvent. Riffs are then generated for the improvisation 210.

"Riffs" are data structures that identify portions of the improvisation. They don't contain MIDI Data, they just point to areas of the musician's original improvisation. Riffs can be up to 32,000 beats in length, but are typically shorter than that. In the preferred embodiment, Riffs for durations of one beat to four bars are generated automatically. For all bars of the improvisation, all possible sequences of notes up to four bars are considered to generate the following Riffs:

4 bar riff, 3 bar riff, 2 bar riff, 1 bar riff, 2 beat riff on beats 1 or 3 (if a new chord is present on that beat, or if the duration of the chord is 1 or 2 beats), and 1 beat riff on beats 1, 2, 3, or 4 (if the chord lasts one beat, or if the beat is beat 1 and the bar is an odd number).

The Riff data structure is listed in Appendix F.

Each Riff includes a certain start time relative to the beginning of the performance, and includes a certain duration number of beats. The starting time and durations of the Riffs are approximations, since the start time and duration of the riff will be modified to correspond to any phrase markers that are nearby. So the actual boundaries for the start, end, and duration of a riff can be on any tick, rather than a whole beat basis.

The algorithm for generating the Riffs is discussed in Appendices G and H.

Once the generation of a Riff is complete, the process is repeated for each possible grouping of notes starting on a bar boundary up to four bars in length in the improvisation, and Riffs of the various lengths are generated.

Then the Riffs are examined to identify and remove "undesirable Riffs". The following Riffs are considered undesirable:

1. A riff containing more than one phrase begin marker.
2. A riff of length 2 beats, with only 1 or 2 notes.
3. A riff of length 1 beat that starts before the beat or ends before the next beat.
4. A riff of duration longer than 2 beats with less than 4 notes, if the riff doesn't start a phrase.
5. A riff with a phrase begin marker after the start of the riff.
6. A riff less than 4 beats, if the outside value of the riff is greater than 3.

The Riff file is then saved. This file is saved as an array of TRiff structures. There is a TRiffHeader structure at the start of this file that stores data about the Riffs such as the number of Riff structures.

Now all of the elements of the "Improvised File Set" have been created. The musician's improvisation as a MIDI Data file has been combined with a ScaleChordRootData array (generated from the input chords and key), and a Riffs file has been generated. If the improvisation is called SongX, the Riffs file is saved with the name SongX.RIF and the MIDI Data and input chords and song key are saved together in a file called SongX.MGU. The process is repeated for each improvisation that is to be included in the Soloist Database. The result is a series of "File Improvisation Sets" (.MGU and .RIF Files and calculated ScaleChordRootData Array). These will be combined into a single Soloist Database.

Figure 2:
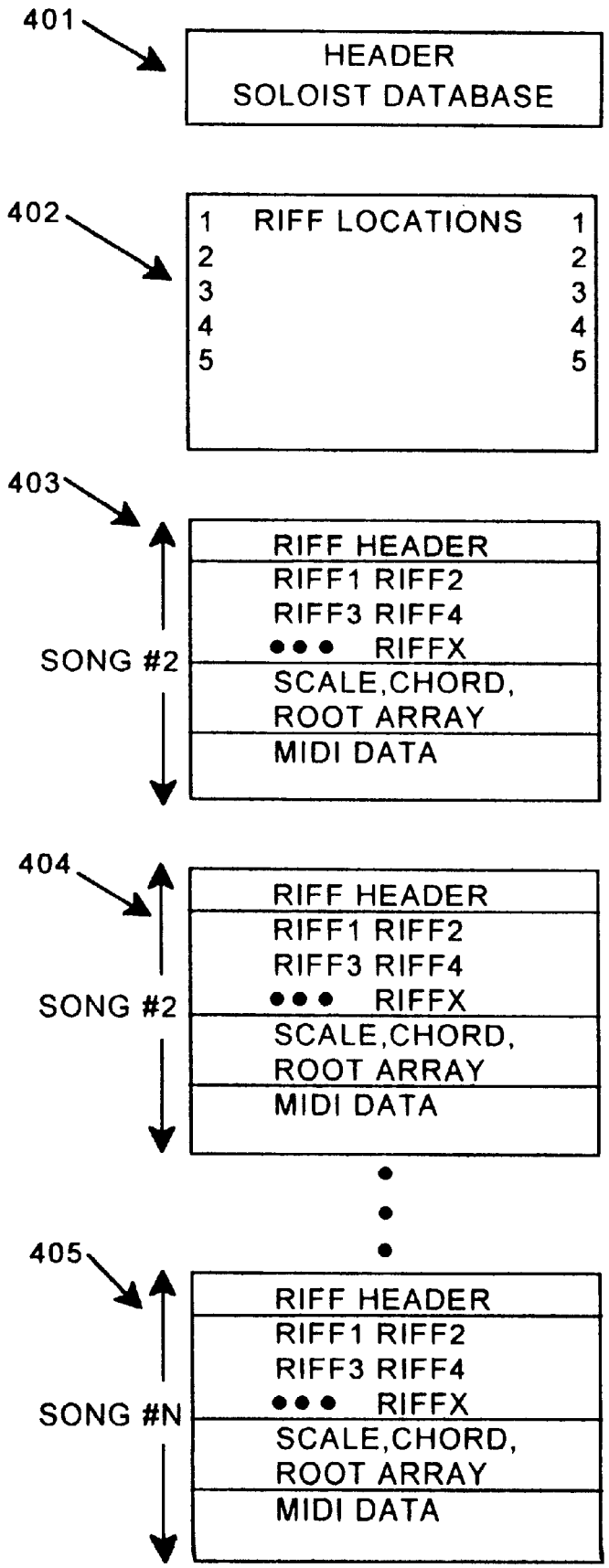
FIG. 2 is a diagram showing the structure of the Soloist Database File.

FIG. 2 shows the structure of the Soloist Database File. The Soloist Database consists of the following sections:

1. Header 401
2. Riff Locations for entire DataBase 402
3. #1 "File Improvisation Set" (.RIF File+ ScaleChordRootDataArray+MIDI Data) 403 #2 "File Improvisation Set" (.RIF File+ ScaleChordRootDataArray+MIDI Data) 404 . . . # N "File Improvisation Set" (RIF File+ ScaleChordRootDataArray +MIDI Data) 405

To generate a Soloist Database, the following method is used. A disk directory is chosen as the source location of the File Improvisation Sets. The .RIF files are identified in that directory. Each of the "File Improvisation Sets" is loaded into RAM, sequentially. They are actually read in twice. As they are read in for the first time, the Riff Locations for each Riff that will be present in the Soloist Database is written to the Soloist Database in the Riff Locations section. This is the offset from the SoloistHeader.RiffDataOffset, and indicates where the Riff data is stored.

When all of the Riff Locations 402 are written, the Soloist Database Header 401 is updated, and written with data of the total number of Riffs in the database, the offset to the start of the File Improvisation Sets, and quantization data about the MIDI Data, (such as how much before or after the beat the information was played (ST2CurLateness field), how much of a "swing" factor the playing was (ST2Cur8ths), and average velocities and durations of the notes in the database.) Other parameters such as the Time Signature, average Tempo, and type of Soloing (even or swing feel, 8th or 16th notes) are written. Then the File improvisation Sets 403 are appended to the Database, with the Riffs being written at the locations specified earlier in the Location Offset field. As the Riff file is written to the Database, the Riff Header is written, and the offset for the location of the ScaleChordRootData and MIDI Data for the Riff file is written to the header. As each Riff is written to the DataBase, the RIFheaderOffset field stores the offset for the Riff Header of the current Riff.

The Soloist Database is then complete. For example, we might have a Jazz Soloist Database (J_SWING.ST2) that contains 20 File Improvisation Sets, of 20 full improvisations by a musician. Each improvisation's duration might average 5 minutes, and be of length 200 bars, so there are a total of 100 minutes of improvisation. The Database stores the complete improvisations, and also includes about 10,000 Riffs that describe details about the various phrases identified in the file. Each Riff can be accessed by a number from 1 to 10,000, by the Location Offset in the file. Once found, the riff data can be examined. The RiffHeaderOffset field holds the location of the RiffHeader. The RiffReader holds the location of the ScaleChordRootData and the MIDI Data that the Riff refers to.

The database can be scanned by Riff number, and any Riff can point to the Riff Header. The Riff Header in turn points to the Scale Chord Data, and MIDI Data. So choosing a Riff can point to the MIDI Data that is associated with the Riff.

Generating a New Improvisation

Based on a prepared Soloist Database (described above), a new improvisation can be created. Chord symbols are entered on to a screen for a song that will be used for the new improvisation. In a manner similar to the description of entering chords above for the "File Improvisation Sets", the chord symbols, tempo, key, and chosen style of music are entered into the program. From the chord symbols and key, the following data is calculated for each beat of the new song:

1. Scale Number
2. Chord Number
3. Relative Root

This is the "ScaleChordRootData Array" for the new improvisation.

Options for the generated solo are set by the user. These will control parameters of the generated improvisation. These are stored in a TSoloist structure which stores information such as:

The Title of The Soloist: Title: Array[0 . . . 29] of char;

The name of the Soloist Database to use:
ST2StyleName:Array[0 . . . 31] of char;

The Instrument to use for the solo: SGPatchNumber

The note range for the solo: (SGlowest noteAllowed, SGhighest noteAllowed)

Range of outside Riffs to include:
SGOutsideRangeLow,SGOutsideRangeHigh:Byte;

Phrase Lengths allowable:
SGUserMinimumPhraseLength,
SGUserMaximumPhraseLength:Byte;

Space Between Phrases to insert:
SGUserInsertSpaceBetweenPhrasesPercent,
SGUserInsertSpaceBetweenPhrasesAmountLow,
SGUserInsertSpaceBetweenPhrasesAmountHigh: Byte;

Quantization Parameters:

LegatoBoost,IncreaseLateness,Increase8ths:ShortInt.

For example, the Soloist Parameters might have the following settings:

Title: "Jazz Alto Sax Bebop Soloist".

The name of the Soloist Database to use: J_SWING.ST2

The Instrument to use for the solo: 66 (=ALTO SAXOPHONE)

The note range for the solo: Note 48 to Note 72

Range of outside Riffs to include: Range 1 to 5

Phrase Lengths allowable: Phrase lengths 4 to 24 beats

Space Between Phrases to insert: Insert space 50% of time, and insert 0 to 4 beats of space Quantization Parameters: Increase Legato by 10%, make the improvisation later by 5 ticks, shorten the swing factor by 5 ticks Additional options are presented to the user. These include When the Soloist should play ("All of the time", "Trading 4's", "Fills") and in what portions of the song (first, middle, last choruses).

When the Generate Solo option is chosen, the system Creates the new improvisation. This example will assume that it is generating an improvisation for the entire piece.

The Generating of a Solo consists of repeatedly picking "Riffs" from the database that meet the selection criteria. Each riff has a certain duration, and, if chosen, results in a certain number of beats of the improvisation being written. When a Riff is chosen as meeting the criteria, the Riff is written to the Improvisation track as MIDI Data, starting at the track pointer. Then the track pointer is incremented by the number of beats in the riff.numbeats field, and the process of choosing riffs and writing MIDI Data that the Riff points to is repeated. Space (silence) is also written to the solo periodically, according to the settings in the Soloist parameters.

Riffs are accessible in the database by Riff Number, and the total number of Riffs is known and stored in the ST2Header.RiffNumberOfRiffs field. The process of picking a successful riff is as follows. A riff number is picked at random (from an array of random numbers) ensuring that once a number is picked, it will not be picked again until all of the numbers have been chosen. Once the Riff Number is picked, its Location in the Database is determined by the RiffLocations.

For example, Riff number 175 would be found at SoloistHeader.RiffLocationsOffset+4*175. Reading the 4 bytes at that offset into a Long Integer variable called "TheLong" would then point to the location of the riff in the file as TheRiffOffset, being equal to TheLong+ SoloistHeader.RiffDataOffset. The Riff is then read at that location. The Riff points to the Riff Header by using the field RifHeaderOffset. The RifHeaderOffset points to the ScaleDataArray and the MIDI Data for that File Improvisation Set.

Figure 3:
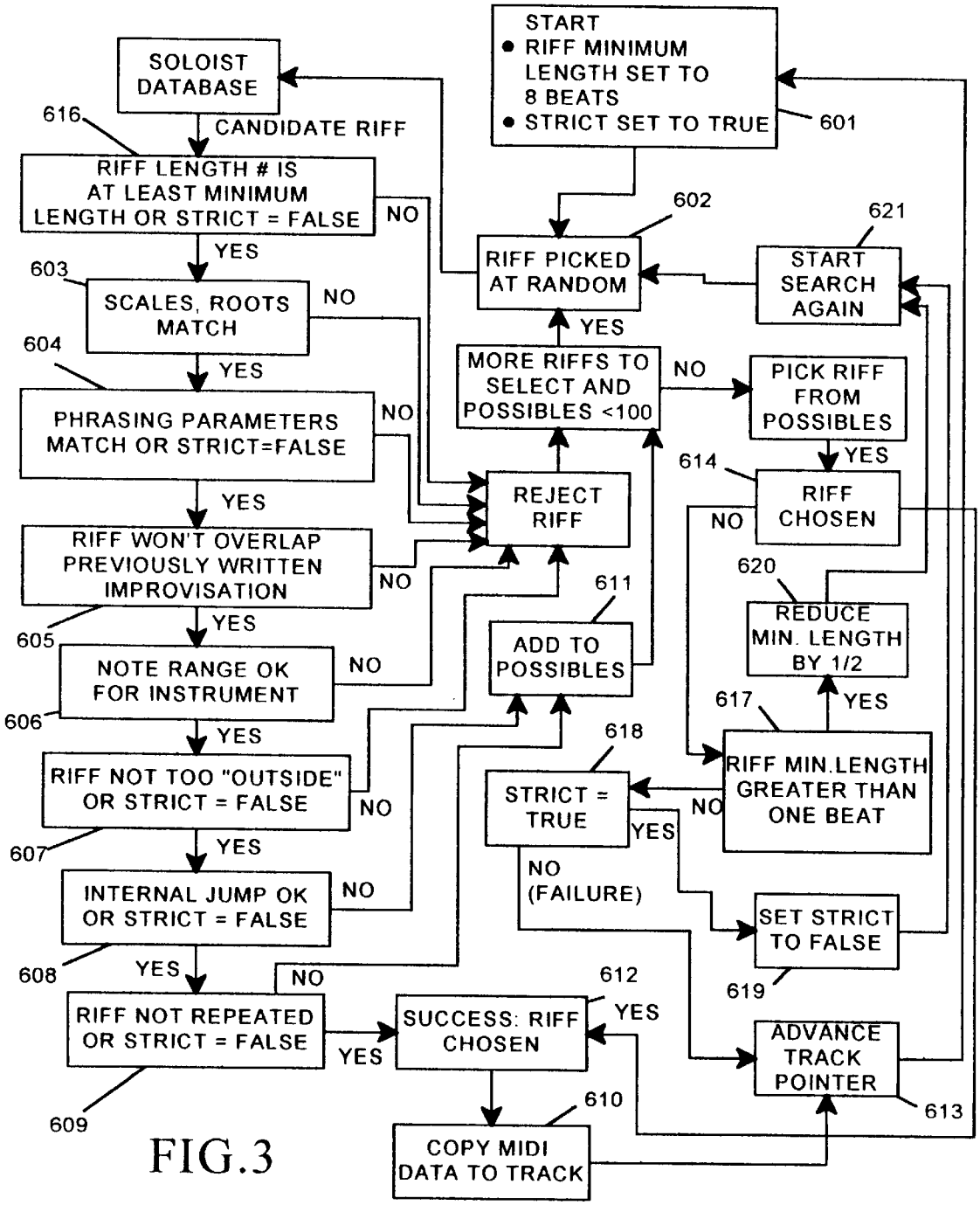
FIG. 3 is a flow chart showing the rules used to choose the successful Riffs.

FIG. 3 is a flow chart showing the rules used to choose the Riffs. The Riff is now evaluated to see if it is Acceptable, Rejected, or Possible.

When the process begins, criteria for selecting the riff are set to "Strict mode" 601. This includes a Boolean variable called "Strict" being set to true, and a requirement that the Riff be of a Minimum Length, which initially is set to two bars (eight beats 4/4 time signature). If the selection process fails (no Riffs are found), these rules are relaxed 619, 620. If the Riff Minimum Length is greater than one beat, it is halved 620, and the search process is repeated. This process results in the longest Riffs being preferentially chosen over the shorter ones. If the Riff Minimum Length is equal to one beat, it cannot be further reduced, so the "Strict" variable is set to false 619, and the search process is repeated.

Once a Riff is deemed to be Rejected, another riff is chosen as a candidate. If a Riff is chosen as "Acceptable", it is deemed successful and is written to the track. If a Riff is chosen as a "possible", it is added to the list of candidates that are chosen. The candidates are chosen after all of the Riffs in the Database have been evaluated, or 100 candidates have been chosen. One of these candidates will then be chosen to be written to the track.

A riff is chosen at random from the Database 602. When evaluating a Riff, the Candidate Riff starts off as Acceptable, and is tested on many criteria to see if it remains Acceptable, or is Rejected, or is Rejected but considered "possible". A transpose factor is calculated, that will transpose the Riff by a factor of semitones. This transpose factor is called "aRiffOverallNoteAdjust".

The Scale Number and Modular Root used for the any beat for the duration of the Riff are compared to the Scale Number and Modular Root required in the song, at the current bar and beat. If either of these are not equal throughout, then the riff is invalid 603. If the Solo needs a new phrase to begin, continue or end and the riff isn't of the same type (beginning, continuing or ending a phrase, then the riff is invalid 604. If the riff starts early (before its start time), and this would result in starting before a previously written part of the solo, the riff is invalid, or if the previous riff written to the track had a hanging note that would be end after the start of the candidate riff, it is rejected 605.

When adjusting the Riff by the transpose factor calculated in the aRiffoverallNoteAdjust variable, the riff is rejected if the Adjusted FirstNote of the Riff is Higher than the HighestNote Allowed in the Soloist Parameters, the Adjusted FirstNote of the Riff is Lower than the LowestNote Allowed in the Soloist Parameters, the Adjusted HighestNote of the Riff is Higher than the HighestNote Allowed in the Soloist Parameters, or the Adjusted LowestNote of the Riff is Lower than the LowestNote Allowed in the Soloist Parameters 606.

If the outside value of the Riff is not in the acceptable outside range of the Soloist Parameters then the Riff is Rejected 607.

Riffs that are Rejected, but are to be considered possible, are assigned a number of "faults" according to the types of mismatches found with the database 611. Riffs that are possible will be chosen if no acceptable Riffs are found.

If the Adjusted FirstNote of the Riff is the same as the last note used in the track, and there is less than ½ beat time between them, the riff is rejected 608. If the AdjustedFirstNote of the Riff is more than three semitones away from the last note in the track, then the riff is possible, and ten Faults are added.

If the Riff has been used previously (in the last sixty riffs, then the riff is rejected if it is in strict mode or if the riff is longer than one bar 609. Otherwise thirty Faults are added. If the previous Riff written to the track was followed by a note one semitone away, and the note was less than one beat away, then if the candidate riff is more than one semitone away, then ten Faults are added.

If a Riff is considered acceptable, it is chosen and written 612. Otherwise, the search continues until all of the Riffs in the Database have been evaluated, or one hundred "possible" candidates have been nominated. In this case the candidates are chosen from among the possible riffs, based on the number of faults for each candidate, and a random selection.

If no Riffs are found, the minimum acceptable length for a riff is reduced by half, and the process is repeated. If the search has failed for a minimum length of one beat, then the "Strict" variable is set to false, 619, and the search then begins again in a non-strict (relaxed) mode. If the search fails 618 when the "Strict" variable is set to false, then the search process fails, and the track pointer is advanced (silence will result over that portion of the improvisation).

Then the Riff is written to the Track 610. The Riff points to the MIDI Data that was the original improvisation. The transpose factor is applied (aRiffOverallNoteAdjust) to the note number of each element. Otherwise the data is transferred with the same timing, duration and pitch information as was in the original improvisation.

The Track Pointer for the new improvisation track is incremented by the number of beats of improvisation that has been written, as stated in the numbeats field of the Riff 613. Then the process is repeated, and another riff is chosen, or space is inserted 614 into the solo track. The process completes when the track pointer reaches the end of the song or region targeted for improvisation.

Quantization algorithms are applied to the written track, based on the following rules: —Faster tempos imply solos should be delayed a few ticks. —Faster Tempos imply that swing 8th notes should be closer together. —Straight feel styles imply that the 8th notes should be even feel. —Swing feel styles imply that the 8th notes should be swing feel.

When the improvisation track is written, it can be played through a MIDI computer soundcard, MIDI module, or saved as a Data file. Since the improvisation can typically be written at a speed faster than the tempo of the song, the song can be playing back as the improvisation is being written, as long as the writing of the improvisation stays ahead of the playback of the song.

While the foregoing description specifies the currently preferred embodiment, numerous other embodiments are equally possible. For example, as mentioned above, instead of recording the performance in MIDI, the performance may be recorded digitally or by traditional analog methods. If the recording is digital, the timing of each note can be measured by the number of samples from the beginning of the piece and the added chord information can be indexed to the sample number. If the recording is analog, such as on tape, a digital track can also be recorded on the tape to mark the start and end of each riff and to store the chords information. Therefore the scope of the invention should not be construed as limited by the above description, but rather should be characterized by the following claims.

---

Appendix A: Chord extensions based on C
(over 100 extensions for each root)

(major chords)

C, CMAJ, C6, CMAJ7, CMAJ9, CMAJ13, C69, CMAJ7#5,
C5b, Caug, C+,
CMAJ9#11, CMAJ13#11, (minor chords)

Cm, Cm6, Cm7, Cm9, Cm11, Cm13,
Cmaug, Cm#5,
CmMAJ7, (half diminished)

Cm7b5, (diminished)

Cdim, (dominant 7th chords)

C7, 7+, C9+, C13+, C13, C7b13, C7#11, C13#11,

-continued

C7#11b13, C9, C9b13, C9#11, C13#11, C9#11b13, C7b9,
C13b9, C7b9b13, C7b9#11, C13b9#11, C7b9#11b13, C7#9,
C13#9, C7#9b13, C9#11, C13#9#11, C7#9#11b13,
C7b5, C13b5, C7b5b13, C9b5, C9b5b13,
C7b5b9, C13b5b9, C7b5b9b13,
C7b5#9, C13b5#9, C7b5#9b13, C7#5, C13#5,
C7#5#11, C13#5#11, C9#5, C9#5#11,
C7#5b9, C13#5b9, C7#5b9#11, C13#5b9#11,
C7#5#9, C13#5#9#11, C7#5#9#11,
C13#5#9#11

(sustained 4 chords)

Csus, C7sus, C9sus,
C13sus, C7susb13, C7sus#11, C13sus#11, C7sus#11b13,
C9susb13, C9sus#11, C13sus#11,
C9sus#11b13, C7susb9, C13susb9,
C7susb9b13, C7susb9#11,
C13susb9#11, C7susb9#11b13, C7sus#9,
C13sus#9, C7sus#9b13, C9sus#11,
C13sus#9#11, C7sus#9#11b18,
C7susb5, C13susb5, C7susb5b13, C9susb5, C9susb5b13, C7susb5b9,
C13susb5b9, C7susb5b9b13, C7susb5#9,
C13susb5#9, C7susb5#9b13,
C7sus#5, C13sus#5,
C7sus#5#11, C13sus#5#11, C9sus#5,
C9sus#5#11, C7sus#5b9, C13sus#5b9,
C7sus#5b9#11, C13sus#5b9#11,
C7sus#5#9, C13sus#5#9#11,
C7sus#5#9#11,
C13sus#5#9#11, Appendix B: Possible Chord Roots (17)

'C', 'Db', 'D', 'Eb', 'E', 'F',
'Gb', 'G', 'Ab', 'A', 'Bb', 'B',
'C#', 'D#', 'F#', 'G#', 'A#'

Appendix C: Possible alternate bass notes (12)

These are expressed as a number of semitones above the root.
For example, in a C/G chord, the G is seven semitones away
from the C, so the bass note is considered to be = 7.

Appendix D: Possible key signatures (34)

'C', 'Db', 'D', 'Eb', 'E', 'F', 'Gb',
'G', 'Ab', 'A', 'Bb', 'B', 'C#',
'D#', 'F#', 'G#', 'A#',
'Cm', 'Dbm', 'Dm', 'Ebm', 'Em', 'Fm',
'Gbm', 'Gm', 'Abm', 'Am', 'Bbm', 'Bm',
'C#m', 'D#m', 'F#m', 'G#m', 'A#m'

Appendix E: Scale Algorithm

This is the algorithm that assigns a scale, based on the chords,
key and the chords following.
(All of the following is illustrated in the key of C.)
Major chords are assigned to IONIAN scale, unless the Root is F or Bb
Major Chords with root of F or Bb are assigned to LYDIAN scale.
Minor or Minor 7 chords are assigned to a DORIAN scale,
    except Em (FRIDJIAN Scale) and Am (AOLIAN Scale)
MinorMaj7 chords or Minor6th chords are assigned to
HARMONIC MINOR SCALE
Minor7b5 chords are assigned to m7b5 SCALE
Dimished chords are assigned to DIMINISHED SCALE
Dominant 7th chords are assigned to "MIXOLYDIAN RESOLVING"
    scale if the next chord is up a 4th
    interval (or down a 5th interval)
If still unassigned, Dominant 7th chords with extensions
    of b9, #9, or b13 are assigned to
    ALTEREDDOMINANT SCALE.
If still unassigned, Dominant 7th chords with extensions
    of 9, 13, or #11 are assigned to
    LYDIANDOMINANT SCALE.
If still unassigned, Dominant 7th chords that are not
    resolving are assigned to LydianDominant
    Scale if the root is D, Eb, F, F#, Bb, Db.
    Otherwise Dominant 7th chords are assigned to
    ALTEREDDOMINANT.

Appendix F: TRiff Structure type TRiff = record
ID, version: LongInt;
RIFheaderOffset: LongInt; {calc during save of the file, -continued this points to data like the memo chord scale
and the MID location}
ST2Offset: LongInt;
ST2RiffNumber: LongInt;
RefNum: LongInt;
TRiffSize: Integer; {size of a TRiff record}
NumBeats: Integer;
StartTime: LongInt; {expressed as bar: beat, with no tick setting}
ScaleChordIndex: Integer; {points to start of ScaleChord data,
eg = 200 implies beat 200, and offset 200*4}
StartTimeOffset: Integer;
EndTimeOffset: Integer;
StartIndex, StartEarlyIndex: Integer;
EndIndex, EndEarlyIndex: Integer;
NoteCount: Integer;
WhiteSpaceStarting, WhiteSpaceEnding: Integer;
WhiteSpacePrevious, WhiteSpaceFollowing: Integer;
StartHang, LastHang: Integer;
TransposeRangeUp: Byte;
TransposeRangeDown: Byte;
NoteFirst, NoteLast, NoteHigh, NoteLow: Byte;
NotePrevious, NoteFollowing: Byte;
NoteEarlyStart: Byte;
Weight: Byte;
InstrumentType: Byte;
Outside: Byte; {0 to 9}
RiffKeyNum: Byte;
RiffStartingScale: Byte;
RiffBooleans: LongInt;
FutureBytes: packed Array[0 . . . 21] of byte;
end;

Appendix G: Algorithm for generating the riffs

The fields of the Riff Structure are filled in with these values:
NumBeats: Integer;
StartTime: LongInt;
The following data is calculated and stored in fields
of the Riff structure:
ScaleChordIndex: Integer; ; This points to the offset in the
ScaleChordData structure (described
previously that corresponds to the start of the Riff)
RiffStartingScale is assigned as by reading the ScaleNumber
field of the ScaleChordData array at index
ScaleChordIndex.
EndTime is set as the StartTime plus the Number of Beats
times 120 ticks.
StartIndex is set as the element of the MIDI array that is the
first note after the StartTime.
EndIndex is set as the element of the MIDI array that is the first
note after the EndTime.
It is determined whether the Riff represents the start of a phrase.
If there is a phrase marker in the improvisation at index StartIndex,
then the Riff starts a phrase and StartTimeOffset becomes 0.
If there is a phrase marker before the start of the riff; but within
1 ½ beats (180 ticks), then the Riff starts a phrase and
StartTimeOffset becomes a negative number equal to the number of
ticks to get to the start of a phrase. StartEarlyIndex is set to the
FirstNote after the StartTime adjusted by the StartTimeOffset.
If there is a phrase marker beginning a new phrase within 180 ticks
of the end of the riff, then the riff is set to end early, before
the new phrase begins. This is done by setting the EndEarlyIndex
to the index of the note beginning the next phrase.
The following data is then calculated for the riff, by examining
the MIDI Data array, and the ScaleChordData Array over the region
bounded by the Riff:
The number of notes in the Riff are counted and stored in
the field "NoteCount: Integer;"
The amount of "silence" with no notes starting for the
beginning of the Riff, and end of the Riff is
stored as ticks in the "WhiteSpaceStarting" and
"WhiteSpaceEnding: Integer;" fields.
If notes from the previous Riff are still sounding,
the duration by which they are still sounding is
stored in the StartHang field.
If the end of the riff leaves some notes still sounding,
the duration of the notes still sounding is stored
in the "LastHang: Integer;" field.
MIDI Data is stored about the Riff such as the starting note
(NoteFirst), EndingNote(NoteLast), the highest note in the riff
(NoteHigh), the lowest note (NoteLow), note previous to the riff -continued (NotePrevious), and note following the Riff (NoteFollowing).
If the note of the next riff is close to the last note
(ie within 1 semitone), and the riff doesn't end a
phrase, then the NextNoteMust Match bit is set to true.
It is determined how "outside" the riff is. This
term is used by musicians to describe how much an improvisation
strays from an expected scale. We assign an outside number of
1 to a riff that stays closely to the scale, and 9 to a riff that
strays from the scale by hitting notes outside of the scale.
A lookup table is used, with indexes of scalenumber and mod
offset from the root of the chord (see Appendix H).
"Outside Notes" are identified as notes with
values greater than zero in this lookup table. Notes less than
20 ticks are not considered outside.
Outside Notes that are chromatically leading to non-outside
notes are not considered outside.
Outside notes that are on the off-beat, and less than 80
ticks duration are considered "Outside passing tones."
Outside notes that are not passing tones are considered
"Outside Tones".
A riff outside value between 1 and 9 is assigned. The score starts
at 1. The outside tones and outside passing tones increase the
outside score, while the length of the phrase, and end or begin
phrase status of the riff will reduce the outside score.

Appendix H: Lookup table for Outside Values, for each scale.

0-inside, 3 = very outside.
Example, on a Dorian scale, the relative root
of 1 has an outside value of 3.
This would apply to an F note on a Em7 chord in the key of D.

| { | C | | D | | E | F | | G | | A | | B} |
|---|---|---|---|---|---|---|---|---|---|---|---|---|
| AssignScale Outside ( JSNO-SCALE, | 0, | 0, | 0, | 0, | 0, | 0, | 0, | 0, | 0, | 0, | 0, | 0); |
| AssignScale Outside ( JSIONIAN, | 0, | 3, | 0, | 2, | 0, | 0, | 3, | 0, | 3, | 0, | 2, | 0); |
| AssignScale Outside ( JSLYDIAN, | 0, | 3, | 0, | 2, | 0, | 0, | 0, | 0, | 3, | 0, | 2, | 0); |
| AssignScale Outside ( JSDORIAN, | 0, | 3, | 0, | 0, | 3, | 0, | 0, | 0, | 2, | 0, | 0, | 2); |
| AssignScale Outside ( JSFRIDJIAN, | 0, | 0, | 2, | 0, | 3, | 0, | 2, | 0, | 0, | 2, | 0, | 2); |
| AssignScale Outside ( JSAOLIAN, | 0, | 3, | 0, | 0, | 3, | 0, | 0, | 0, | 0, | 2, | 0, | 2); |
| AssignScale Outside ( JSMINMAJ7, | 0, | 3, | 0, | 0, | 3, | 0, | 2, | 0, | 0, | 0, | 1, | 0); |
| AssignScale Outside ( JSMIX-OLYD, | 0, | 2, | 0, | 2, | 0, | 0, | 2, | 0, | 2, | 0, | 0, | 3); |
| AssignScale Outside ( JSMIX-OLYD-RESOLVE, | 0, | 1, | 0, | 1, | 0, | 0, | 2, | 0, | 1, | 0, | 0, | 3); |
| AssignScale Outside ( JSLYD7, | 0, | 2, | 0, | 2, | 0, | 0, | 0, | 0, | 2, | 0, | 0, | 2); |
| AssignScale Outside ( JSALT, | 0, | 0, | 0, | 0, | 0, | 0, | 0, | 0, | 0, | 0, | 0, | 3); |
| AssignScale Outside ( JSBLUES, | 0, | 2, | 0, | 0, | 0, | 0, | 0, | 0, | 2, | 0, | 0, | 3); |
| AssignScale Outside ( JSSUS, | 0, | 2, | 0, | 2, | 0, | 0, | 2, | 0, | 2, | 0, | 0, | 3); |
| AssignScale Outside ( JSM7b5, | 0, | 0, | 1, | 0, | 3, | 0, | 0, | 2, | 0, | 2, | 0, | 3); |
| AssignScale Outside | 0, | 1, | 0, | 0, | 2, | 0, | 0, | 2, | 0, | 0, | 2, | 0); |

-continued ( JS_DIM,

I claim:

1. A method for generating by computer a musical performance for a sequence of chords, comprising:

(a) storing in a memory a musical performance comprised of data representing a sequence of musical sounds and timing for the sounds and, associated with the timing data, a stored sequence of a plurality of chord roots;

(b) receiving a first specification of a sequence of a plurality of chord roots input by a user;

(c) selecting from the memory a first portion of the musical performance having a stored sequence of a plurality of chord roots which is the same as the first input sequence of a plurality of chord roots;

(d) receiving a second specification of a sequence of a plurality of chord roots input by a user;

(e) selecting from the memory a second portion of the musical performance having a stored sequence of a plurality of chord roots which is the same as the second input sequence of a plurality of chord roots; and (f) assembling the first portion and the second portion into a performance.

2. The method of claim 1 wherein the data representing a sequence of musical sounds is MIDI data.

3. The method of claim 1 wherein the data representing a sequence of musical sounds is digital audio data.

4. A method for generating by computer a musical performance for a sequence of chords, comprising:

(a) storing in a memory a musical performance comprised of data representing a sequence of musical sounds and timing for the sounds and, associated with the timing data, a stored sequence of a plurality of chord roots wherein a plurality of portions of the musical performance are each identified by data in said memory as a riff, each riff having an associated sequence of a plurality of chord roots;

(b) receiving a first specification of a sequence of a plurality of chord roots input by a user; and (c) selecting from said memory a first one of said riffs of the musical performance having an associated stored sequence of a plurality of chord roots which is the same as the first input sequence of a plurality of chord roots.

5. The method of claim 4 further including:

(d) storing in the memory, associated with the stored sequence of chord roots a stored sequence of parameters, one parameter for each chord root;

(e) in said step receiving a first specification of an input sequence of chords input by a user, also receiving each chord an extension;

(f) converting each input chord to a chord root and a parameter where the parameter is based in part on the extension of the input chord; and (g) in said step selecting from said memory a first riff, said riff has a stored sequence of chord roots and parameters which is the same as the first input sequence of chords after converting each input extension to a parameter.

6. The method of claim 5 further including:

(a) receiving a second specification of an input sequence of a plurality of chords, each chord having a root and an extension;

(b) converting each input chord to a chord root and a parameter where the parameter is based in part on the extension of the input chord;

(c) selecting from the memory a second riff having a stored sequence of chord roots and parameters which is the same as the second input sequence of chord roots and parameters; and (d) assembling the first riff and the second riff into a performance.

7. The method of claim 6 wherein the data representing a sequence of musical sounds is MIDI data.

8. The method of claim 6 wherein the data representing a sequence of musical sounds is digital audio data.

9. The method of claim 5, further including:

(a) storing in the memory associated with each riff data indicating the degree to which the musical sounds of the riff deviate from musical sounds of a scale;

(b) receiving from a user an indication of a preference for a degree to which a selected riff includes musical sounds which deviate from musical sounds of a scale; and (c) selecting a riff based in part on whether the riff includes musical sounds which deviate from musical sounds of a scale to the degree preferred by the user.

10. The method of claim 6 further including the sub-steps of:

(a) also storing in the memory, associated with the stored sequence of chord roots, a phrase end marker associated with a particular chord root and a phrase begin marker associated with the next chord root in the sequence;

(b) when selecting the second riff reading the memory to determine whether the last chord root of the first riff has an associated phrase end marker;

(c) if the last chord root of the first riff has an associated phrase end marker, selecting for the second riff a sequence of chord roots which begins with a chord root associated with a phrase begin marker; and (d) if the last chord root of the first riff does not have an associated phrase end marker, selecting for the second riff a sequence of chord roots which does not begin with a chord root associated with a phrase begin marker.

11. The method of claim 10 further comprising the substep of, if the last chord root of the first riff has an associated phrase end marker, inserting a period of silence between the first riff and the second riff.

12. The method of claim 6 further including the substeps of:

(a) when selecting the second riff reading the memory to determine for the last musical sound of the first riff a musical pitch; and (b) selecting for the second riff a sequence of chord roots which begins with a musical sound which has a musical pitch which is close to the musical pitch of the last musical sound of the first riff.

13. A data storage medium containing a computer program for operating with a database of recorded musical performances to generate an improvisation which, when run on a computer, causes the computer to perform the following steps:

(a) receiving a first specification of a sequence of a plurality of chord roots input by a user;

(b) reading from a memory data representing a plurality of stored sequences of chord roots, one for each of a plurality of sequences of musical sounds stored in the memory;

(c) selecting from the memory a first sequence of musical sounds having a stored sequence of a plurality of chord roots which is the same as the first input sequence of a plurality of chord roots, (d) receiving a second specification of a sequence of a plurality of chord roots input by a user;

(e) selecting from the memory a second sequence of musical sounds having a stored sequence of a plurality of chord roots which is the same as the second input sequence of a plurality of chord roots; and (f) assembling the first sequence of musical sounds and the second sequence of musical sounds into a performance.

14. The data storage medium of claim 13 wherein the data representing a sequence of musical sounds is MIDI data.

15. The data storage medium of claim 13 wherein the data representing a sequence of musical sounds is digital audio data.

16. The data storage medium of claim 13 which further causes the computer to perform the following steps:

(a) storing in the memory associated with each riff data indicating the degree to which the musical sounds of the riff deviate from musical sounds of a scale;

(b) receiving from a user an indication of a preference for a degree to which a selected riff includes musical sounds which deviate from musical sounds of a scale; and (c) selecting a riff based in part on whether the riff includes musical sounds which deviate from musical sounds of a scale to the degree preferred by the user.

17. A data storage medium containing a computer program for operating with a database of recorded musical performances to generate an improvisation which, when run on a computer, causes the computer to perform the following steps:

(a) reading from a memory data representing a plurality of stored sequences of chord roots and for each chord root an associated parameter, one sequence of chord roots and parameters for each of a plurality of sequences of musical sounds stored in the memory;

(b) receiving a first specification of a sequence of a plurality of chords input by a user, each chord having a root and an extension;

(c) converting each input chord root and extension to a chord root and a parameter where the parameter is based in part on the extension of the input chord; and (d) selecting from the memory a first sequence of musical sounds having a stored sequence of a plurality of chord roots and parameters which is the same as the first input sequence of a plurality of chords after converting each input chord root and extension to a chord root and parameter.

18. The data storage medium of claim 17 which further causes the computer to perform the following steps:

(a) receiving a second specification of an input sequence of a plurality of chords input by a user, each chord having a root and an extension;

(b) converting each input chord to a chord root and a parameter where the parameter is based in part on the extension of the input chord;

(c) selecting from the memory a second sequence of musical sounds having a stored sequence of a plurality of chord roots and parameters which is the same as the second input sequence of a plurality of chords after converting each input chord root and extension to a chord root and parameter; and (d) assembling the first sequence of musical sounds and the second sequence of musical sounds into a performance.

19. The data storage medium of claim 18 wherein the data representing a sequence of musical sounds is MIDI data.

20. The data storage medium of claim 18 wherein the data representing a sequence of musical sounds is digital audio data.

21. The data storage medium of claim 15 which further causes the computer to perform the substeps of:

(a) also storing in the memory, associated with the stored sequence of chord roots, a phrase end marker associated with a particular chord root and a phrase begin marker associated with the next chord root in the sequence;

(b) when selecting the second riff, reading the memory to determine whether the last chord root of the first riff has an associated phrase end marker;

(c) if the last chord root of the first riff has an associated phrase end marker, selecting for the second riff a sequence of chord roots which begins with a chord root associated with a phrase begin marker; and (d) if the last chord root of the first riff does not have an associated phrase end marker, selecting for the second riff a sequence of chord roots which does not begin with a chord root associated with a phrase begin marker.

22. The data storage medium of claim 21 which further causes the computer to perform the substep of, if the last chord root of the first riff has an associated phrase end marker, inserting a period of silence between the first riff and the second riff.

23. The data storage medium of claim 18 which further causes the computer to perform the substeps of:

(a) when selecting the second riff, reading the memory to determine for the last musical sound of the first riff a musical pitch; and (b) selecting for the second riff a sequence of chord roots which begins with a musical sound which has a musical pitch which is close to the musical pitch of the last musical sound of the first riff.

24. A system for operating with a database of recorded musical performances to generate an improvisation, comprising:

(a) means for receiving a first specification of a sequence of a plurality of chord roots input by a user;

(b) means for reading from a memory data representing a plurality of stored sequences of chord roots, one for each of a plurality of sequences of musical sounds stored in the memory;

(c) means for selecting from the memory a first sequence of musical sounds having a stored sequence of a plurality of chord roots which is the same as the first input sequence of a plurality of chord roots;

(d) means for receiving a second specification of a sequence of a plurality of chord roots input by a user;

(e) means for selecting from the memory a second sequence of musical sounds having a stored sequence of a plurality of chord roots which is the same as the second input sequence of a plurality of chord roots; and (f) means for assembling the first sequence of musical sounds and the second sequence of musical sounds into a performance.

25. The system of claim 24 wherein the data representing a sequence of musical sounds is MIDI data.

26. The system of claim 24 wherein the data representing a sequence of musical sounds is digital audio data.

27. The system of claim 24 further including:

(a) means for storing in the memory associated with each riff data indicating the degree to which the musical sounds of the riff deviate from musical sounds of a scale;

(b) means for receiving from a user an indication of a preference for a degree to which a selected riff includes musical sounds which deviate from musical sounds of a scale; and (c) means for selecting a riff based in part on whether the riff includes musical sounds which deviate from musical sounds of a scale to the degree preferred by the user.

28. A system for operating with a database of recorded musical performances to generate an improvisation, comprising:

(a) means for reading from a memory data representing a plurality of stored sequences of chord roots and for each chord root an associated parameter, one sequence of chord roots and parameters for each of a plurality of sequences of musical sounds stored in the memory;

(b) means for receiving a first specification of a sequence of a plurality of chords input by a user, each chord having a root and an extension;

(c) means for converting each input chord root and extension to a chord root and a parameter where the parameter is based in part on the extension of the input chord; and (d) means for selecting from the memory a first sequence of musical sounds having a stored sequence of a plurality of chord roots and parameters which is the same as the first input sequence of a plurality of chords after converting each input chord root and extension to a chord root and parameter.

29. The system of claim 28 further comprising:

(a) means for receiving a second specification of an input sequence of a plurality of chords input by a user, each chord having a root and an extension;

(b) means for selecting from the memory a second sequence of musical sounds having a stored sequence of a plurality of chord roots and parameters which is the same as the second input sequence of a plurality of chords after converting each input chord root and extension to a chord root and parameter; and (c) means for assembling the first sequence of musical sounds and the second sequence of musical sounds into a performance.

30. The system of claim 29 wherein the data representing a sequence of musical sounds is MIDI data.

31. The system of claim 29 wherein the data representing a sequence of musical sounds is digital audio data.

32. The system of claim 29 further comprising:

(a) means for also storing in the memory, associated with the stored sequence of chord roots, a phrase end marker associated with a particular chord root and a phrase begin marker associated with the next chord root in the sequence; and (b) means for, when selecting the second riff, reading the memory to determine whether the last chord root of the first riff has an associated phrase end marker; and (i) if the last chord root of the first riff has an associated phrase end marker, selecting for the second riff a sequence of chord roots which begins with a chord root associated with a phrase begin marker; and (ii) if the last chord root of the first riff does not have an associated phrase end marker, selecting for the second riff a sequence of chord roots which does not begin with a chord root associated with a phrase begin marker.

33. The system of claim 32 further comprising means for, if the last chord root of the first riff has an associated phrase end marker, inserting a period of silence between the first riff and the second riff.

34. The system of claim 29 further comprising:

(a) means for, when selecting the second riff, reading the memory to determine for the last musical sound of the first riff a musical pitch; and (b) means for selecting for the second riff a sequence of chord roots which begins with a musical sound which has a musical pitch which is close to the musical pitch of the last musical sound of the first riff.

35. A data storage medium containing a database of recorded musical performances suitable for generating improvisations, comprising:

(a) data representing a musical performance consisting of a sequence of musical sounds and timing data for the sounds;

(b) data identifying within the sequence of musical sounds a plurality of riffs, each riff consisting of a portion of the sequence of musical sounds including at least two musical sounds, each riff identifying a different portion of the sequence of musical sounds from each other riff, and at least two of the riffs identifying portions of the sequence of musical sounds which portions overlap each other; and (c) data representing a sequence of chord roots, each chord root associated with the timing data, the sequence including at least one chord root for each riff.

36. The data storage medium of claim 35 wherein the data representing a sequence of musical sounds is MIDI data.

37. The data storage medium of claim 35 wherein the data representing a sequence of musical sounds is digital audio data.

38. The data storage medium of claim 35, further comprising:

(a) phrase begin data associated with each riff indicating whether the riff follows a period of silence in the data representing the musical performance, and (b) phrase end data stored with each riff indicating whether the riff is followed by a period of silence in the data representing the musical performance.

39. The data storage medium of claim 35 further comprising data associated with each riff indicating the degree to which the musical sounds of the riff deviate from musical sounds of a scale.

40. The data storage medium of claim 35 further comprising, associated with the timing data, data representing a sequence of parameters, each parameter based in part on a chord extension.

41. A method for creating a database of riffs, comprising:

(a) recording in a memory data representing a musical performance consisting of a sequence of musical sounds and timing data for the sounds;

(b) adding to the memory data identifying within the sequence of musical sounds a plurality of riffs, each riff consisting of a portion of the sequence of musical sounds, including at least tow musical sounds, each riff identifying a different portion of the sequence of musical sounds from each other riff; and (c) adding to the memory data representing a sequence of chord roots, each chord root associated with the timing data, the sequence including at least one chord root for each riff.

42. The method of claim 41 wherein the data representing a sequence of musical sounds is MIDI data.

43. The method of claim 41 wherein the data representing a sequence of musical sounds is digital audio data.

44. The method of claim 41 wherein at least two of the riffs identify overlapping portions of the sequence of musical sounds.

45. The method of claim 41 further including the additional step of adding to the memory, associated with the timing data, data representing a sequence of parameters, each parameter based on a chord extension.

46. A system for creating a database of riffs, comprising:

(a) means for recording in a memory data representing a musical performance consisting of a sequence of musical sounds and timing data for the sounds;

(b) means for adding to the memory data identifying within the sequence of musical sounds a plurality of riffs, each riff consisting of a portion of the sequence of musical sounds including at least two musical sounds, each riff identifying a different portion of the sequence of musical sounds from each other riff; and (c) means for adding to the memory data representing a sequence of chord roots, each chord root associated with the timing data, the sequence including at least one chord root for each riff.

47. The system of claim 46 wherein the data representing a sequence of musical sounds is MIDI data.

48. The system of claim 46 wherein the data representing a sequence of musical sounds is digital audio data.

49. The system of claim 46 further including means for causing at least two of the riffs to identify overlapping portions of the sequence of musical sounds.

50. The system of claim 46 further including means for adding to the memory, associated with the timing data, data representing a sequence of parameters, each parameter based on a chord.

51. The system of claim 46 further comprising means for generating and adding to the memory data associated with each riff indicating whether the riff follows a period of silence in the data representing the musical performance, and (a) phrase end data stored with each riff indicating whether the riff is followed by a period of silence in the data representing the musical performance.

52. The system of claim 46 further comprising means for generating and adding to the memory data associated with each riff indicating the degree to which the musical sounds of the riff deviate from musical sounds of a scale.

* * * * *